US011578419B2

(12) United States Patent
Preikschat et al.

(10) Patent No.: US 11,578,419 B2
(45) Date of Patent: Feb. 14, 2023

(54) AQUEOUS, ALKALINE ELECTROLYTE FOR DEPOSITING ZINC-CONTAINING LAYERS ONTO SURFACES OF METAL PIECE GOODS

(71) Applicants: Carl Freudenberg KG, Weinheim (DE); Provexa AB, Goeteborg (SE)

(72) Inventors: Patricia Preikschat, Ruesselsheim am Main (DE); Anders Skalsky, Goeteborg (SE)

(73) Assignees: CARI, FREUDENBERG KG, Weinheim (DE); PROVEXA AB, Goeteborg (SE)

( * ) Notice: Subject to any disclaimer, the term of this patent is extended or adjusted under 35 U.S.C. 154(b) by 0 days.

(21) Appl. No.: 16/472,217

(22) PCT Filed: Dec. 22, 2017

(86) PCT No.: PCT/EP2017/084331

§ 371 (c)(1),
(2) Date: Jun. 21, 2019

(87) PCT Pub. No.: WO2018/115413

PCT Pub. Date: Jun. 28, 2018

(65) Prior Publication Data

US 2020/0115814 A1 Apr. 16, 2020

(30) Foreign Application Priority Data

Dec. 22, 2016 (DE) ..... 10 2016 015 366.0

(51) Int. Cl.
*C25D 3/56* (2006.01)
*C23F 11/00* (2006.01)

(52) U.S. Cl.
CPC ..... *C25D 3/565* (2013.01); *C23F 11/00* (2013.01)

(58) Field of Classification Search
CPC ..... C25D 3/56; C25D 3/562; C25D 3/565
(Continued)

(56) References Cited

U.S. PATENT DOCUMENTS

| | | | |
|---|---|---|---|
| 4,488,942 | A | 12/1984 | Martin et al. |
| 4,746,411 | A | 5/1988 | Klos et al. |
| 4,923,575 | A | 5/1990 | Voss et al. |
| 5,082,748 | A | 1/1992 | Ahn et al. |

(Continued)

FOREIGN PATENT DOCUMENTS

| | | | |
|---|---|---|---|
| DE | 3428345 | A1 | 2/1985 |
| DE | 3619385 | A1 | 12/1987 |

(Continued)

OTHER PUBLICATIONS

Bhan et al., "The Fe—Mn—Zn System (Iron-Manganese-Zinc)," Journal of Phase Equilibria (Dec. 1, 1991), vol. 12, No. 6, pp. 667-672. (Year: 1991).*

(Continued)

*Primary Examiner* — Edna Wong
(74) *Attorney, Agent, or Firm* — Leydig, Voit & Mayer, Ltd.

(57) ABSTRACT

The invention relates to an aqueous, alkaline electrolyte for electrochemically depositing a zinc-, iron-, manganese-containing layer onto surfaces of metal piece goods, in particular piece goods made of iron and/or steel, characterized in that the electrolyte contains: zinc ions in an amount of 4-60 g/L; iron ions in an amount of 0.5-30 g/L; manganese ions in an amount of 0.1-15 g/L. The invention also relates to a method for electrochemically depositing a zinc-, iron-, manganese-containing layer onto one or more surfaces of a metal piece good. The invention also relates to a metal piece good comprising a zinc-, iron, manganese-containing layer electrochemically deposited onto a surface of the metal piece good in accordance with the inventive method.

18 Claims, 3 Drawing Sheets

(58) Field of Classification Search
USPC ..... 205/238, 245
See application file for complete search history.

(56) References Cited

U.S. PATENT DOCUMENTS

| | | | | |
|---|---|---|---|---|
| 5,597,465 | A * | 1/1997 | Pedrazzini | C23C 22/365 204/486 |
| 6,287,704 | B1 * | 9/2001 | Preikschat | C23C 22/34 106/14.21 |
| 6,652,728 | B1 * | 11/2003 | Sonntag | C25D 3/22 205/143 |
| 9,284,655 | B2 | 3/2016 | Kuhn et al. | |
| 9,322,107 | B2 | 4/2016 | Brunner et al. | |
| 2012/0160698 | A1 * | 6/2012 | Brunner | C08G 71/02 205/244 |
| 2016/0348209 | A1 | 12/2016 | Baumgart et al. | |
| 2017/0022621 | A1 * | 1/2017 | Niikura | C25D 3/565 |

FOREIGN PATENT DOCUMENTS

| | | | | | |
|---|---|---|---|---|---|
| DE | 3943243 | A1 | | 7/1990 | |
| DE | 10306823 | A1 | | 9/2004 | |
| DE | 102005049789 | A1 | | 4/2007 | |
| DE | 102012024616 | A1 | | 6/2014 | |
| EP | 0329057 | A1 | | 8/1989 | |
| EP | 0346740 | A1 | | 12/1989 | |
| EP | 2290133 | A1 | | 3/2011 | |
| EP | 2292679 | A1 | | 3/2011 | |
| JP | 58210191 | A | | 12/1983 | |
| JP | 63176490 | A | | 7/1988 | |
| JP | 2016098382 | A | | 5/2016 | |
| KR | 19920012528 | A | * | 7/1992 | C25D 5/10 |
| WO | WO-2016075963 | A1 | * | 5/2016 | C25D 3/565 |

OTHER PUBLICATIONS

Liao et al., "Study of Zinc-Iron Alloy Electrodeposition Using a Rotating Cylinder Hull Cell," Plating and Surface Finishing, (Mar. 1, 1998), vol. 85, No. 3, pp. 60-66. (Year: 1998).*

International Searching Authority, "Written Opinion of the International Searching Authority," dated Mar. 12, 2018, pp. 1-8, WIPO, Switzerland.

* cited by examiner

AQUEOUS, ALKALINE ELECTROLYTE FOR DEPOSITING ZINC-CONTAINING LAYERS ONTO SURFACES OF METAL PIECE GOODS

CROSS-REFERENCE TO PRIOR APPLICATIONS

This application is a U.S. National Phase application under 35 U.S.C. § 371 of International Application No. PCT/EP2017/084331, filed on Dec. 22, 2017, and claims benefit to German Patent Application No. DE 10 2016 015 366.0, filed on Dec. 22, 2016. The International Application was published in German on Jun. 28, 2018 as WO 2018/115413 under PCT Article 21(2).

FIELD

The present invention relates to an aqueous, alkaline electrolyte and to a method for depositing zinc-containing layers onto surfaces of metal piece goods.

BACKGROUND

In the prior art, different methods are available for protecting metallic material surfaces against corrosive environmental influences. A method that is widespread and established in the art is the application of a metallic coating onto the metal workpiece to be protected. For example, workpieces made of iron and steel are often galvanized in order to protect them from corrosive environmental influences. In this instance, the coating metal may behave in the corroding medium more like a noble metal or more like a base metal than the parent metal material on its own. If the coating metal behaves more like a base metal, in the corrosive medium it functions as a sacrificial anode, in the sense of cathodic corrosion protection, as compared to the host metal. Thus, the corrosion protection of zinc is based on the fact that it is even less noble than the parent metal, and therefore draws the corrosive attack exclusively to itself first.

The deposition of zinc-containing layers onto surfaces is widely used in many fields of technology. Zinc coatings are thereby especially suitable in the field of functional coatings. For example, it is typical to coat small parts such as screws, nuts, washers, prefabricated structural elements such as angled plates or connecting plates and the like in mass quantities.

The zinc layer may be applied with various chemical and physical methods, for example in a hot dip galvanization, where alloys are typical, but especially by means of electrodeposition. For galvanization, different electrolytes with very specific properties are used, wherein uniformity and degree of gloss may be adjusted by means of organic additives. Typical electrolyte compositions are described in numerous patents; listed in the following are only the significant electrolyte types:

a. more or less strongly acidic sulfate electrolytes (practical exclusively for continuous galvanization of pipes and strips with very high current densities and high relative velocity, usually without any organic additives)
b. weakly acidic chloride electrolytes (only in exceptional cases for continuous strip galvanization, since they absolutely require organic additives; chloride electrolytes are used almost exclusively in piece electroplating for relatively rapid and, in part, high-gloss galvanization)

c. alkaline-cyanide electrolytes, especially historically for piece electroplating in rack and drum applications
d. alkaline, cyanide-free electrolytes, for piece electroplating Weakly acidic chloride electrolytes are generally characterized by a very good covering capacity and a rapid deposition rate with excellent efficiency, but they typically have a poor metal distribution, i.e. the produced zinc layer has large layer thickness differences. In alkaline electrolytes, the zinc is present as an anion, i.e. as a zincate ion, and in addition complexing agents may also be present, historically particularly preferably cyanide. However, these have largely been replaced by cyanide-free alkaline zinc electrolytes that possess quite acceptable values for the efficiency, and thus the deposition rate, with a very good metal distribution. Here, "cyanide-free" means that sodium cyanide or potassium cyanide are not intentionally added as a conducting salt, as before. Small, naturally present or resulting traces of cyanide may occur even in cyanide-free electrolytes. In addition, in both weakly acidic chloride electrolytes and in the various alkaline electrolytes, specific organic additives are necessarily used, for example polymers, surfactants, complexing agents, and polar molecules, that influence the gloss level, what are known as brighteners.

For its part, the electrolytically deposited zinc layer is normally sacrificed so quickly in corrosive media such as saline solutions, acids, or alkaline solutions and with the formation of solid, voluminous corrosion products, so that it is itself almost always protected from overly rapid sacrifice by an additional barrier layer, typically a conversion layer (chromating, passivation) and/or a thin lacquer layer (sealing, sealer, topcoat). Consequently, the achieved corrosion protection is usually expressed in relation to two types of corrosion: The coating corrosion, thus the formation of the zinc corrosion products, also known as "white corrosion", and the parent metal corrosion, also called "red rust" in the case of iron or steel. Typical testing methods are the neutral salt spray test DIN EN ISO 9227 or ASTM B117, and climatic change tests such as VDA 233-102, for example. A certain degree of white corrosion is normal for cathodic corrosion protection, as this is part of the protection mechanism, but company specifications increasingly demand high corrosion protection values in the salt spray test without visible alteration.

Here, the zinc+passivation system has reached a technical limit that cannot be further exceeded, but is quite sufficient for many applications. For higher requirements, numerous zinc alloys (co-deposits of zinc with one or more additional metals) have been proposed since approximately the 1980s, of which essentially zinc/cobalt and zinc/iron (both with very low alloying fractions of less than 1% Co or Fe, respectively) and zinc/nickel (>7% Ni) have had a wider practical application. Of these, zinc/nickel with a nickel content of 13-15% has by now prevailed as nearly the sole zinc alloy system, representing the present optimum with regard to corrosion protection, heat resistance, and avoidance of contact corrosion with aluminum alloys. This layer is widely used, most of all in the automotive industry. In piece electroplating, the other electrodeposited zinc alloys have been entirely, or for the most part, supplanted by zinc/nickel.

Unfortunately, nickel has the disadvantage of constituting a strong allergen. Moreover, zinc/nickel layers sometimes break down if the nickel content becomes too high, and this already starts at approximately 17% nickel. Such a layer is no longer less noble in relation to the parent metal, and therefore loses its function as a sacrificial anode in the cathodic anticorrosion system.

It is therefore necessary to develop a zinc-containing layer which, even without nickel, provides approximately the same high level of corrosion protection as zinc/nickel layers, but without the disadvantages thereof.

A large number of zinc alloys without nickel have been described in the literature. For example, it is known from DE 103 06 823 A1 to deposit zinc-manganese alloys, but here the corrosion products are bright red-brown in color and can hardly be distinguished from red rust. Since the 1980s, zinc/iron layers with a higher iron content than the commercially used layers cited above, having only approximately 0.5% iron, have also been described, for example in patent applications JP 58210191 NISSHIN STEEL (1982), DE3428345 OMI (1983), DE3619385 Elektro-Brite (1987). However, these have not previously been able to prevail, among other things because their corrosion protection is not constantly high, and there are always massive outliers with a great deal of white corrosion products. Zinc/iron electrolytes have been proposed as more or less strongly acidic sulfate electrolytes for continuous strip and tube coating, and as alkaline electrolytes for piece electroplating in rack and drum installations.

Although there is a Japanese patent application from 1987 (JP63176490A) which describes a phosphatizable zinc/iron/manganese layer, this is a process in a sulfate electrolyte with very high current densities and belt speeds, as is customary for electrolytic strip galvanization. Sulfate electrolytes are not suitable for piece electroplating since they are optimized for the high velocity and current densities (approximately 50-100 times more than is customary in piece electroplating), and moreover react very sensitively to different anode-cathode distances. In addition, they cannot be adjusted with organic additives, or can be adjusted only with difficulty. In strip galvanization, the anode-cathode distance is set in a fixed manner and does not vary in practice. In piece electroplating, parts are coated that are not simply just a flat plate, but rather are completely formed or even cast parts with three-dimensional geometry that is to some extent challenging. Therefore, the teaching described in JP63176490A is not usable for the present object.

It is therefore necessary to find an alkaline electrolyte which can be used for rack and drum electroplating, with good metal distribution and uniform alloy composition, which can be adjusted with organic additives. It should also be possible to electrolytically deposit zinc, iron, and manganese with sufficient homogeneity onto highly shaped components in a wide current density range.

SUMMARY

In an embodiment, the present invention provides an aqueous, alkaline electrolyte for electrochemically depositing a zinc-, iron-, manganese-containing layer onto surfaces of metal piece goods, characterized in that the electrolyte contains: zinc ions in an amount of 4-60 g/L; iron ions in an amount of 0.5-30 g/L; and manganese ions in an amount of 0.1-15 g/L. In an embodiment, the metal piece goods are made of iron and/or steel.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached figures which illustrate the following.

DETAILED DESCRIPTION OF THE INVENTION

Figure 1:
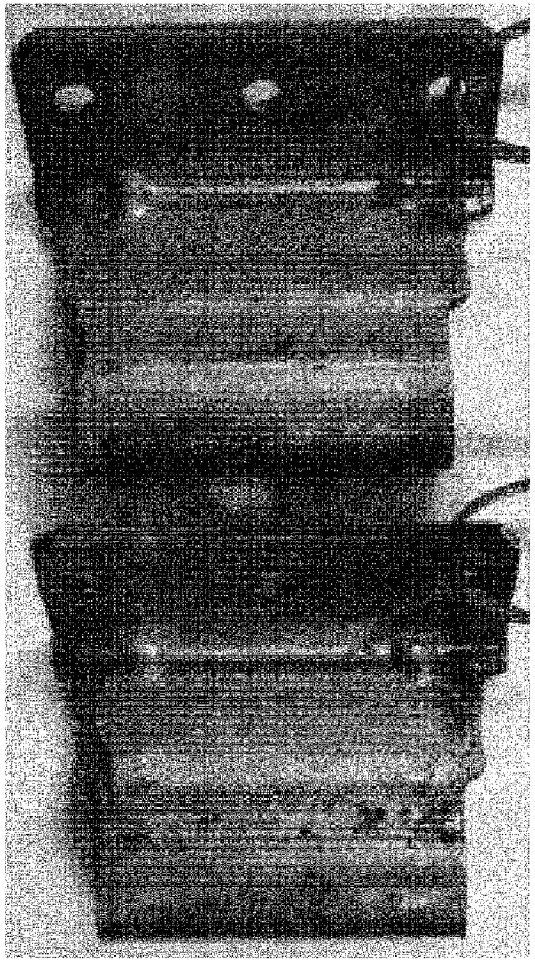
FIG. 1 depicts the results of the coating corrosion in the neutral salt spray test up to 1608 h as described in the Examples.

In an embodiment, the present invention provides an aqueous, alkaline electrolyte. In yet another embodiment, the present invention provides a method for depositing zinc-containing layers onto surfaces of metal piece goods.

In embodiments, the present invention provides an aqueous, alkaline electrolyte and a method for depositing zinc-containing layers onto surfaces of piece goods, in which the piece goods are introduced into the aqueous, alkaline electrolyte.

In an embodiment, the invention further provides a piece good provided with a zinc-containing layer, and to the use of the zinc-containing layer as corrosion protection on metallic piece goods, in particular those made of iron and steel.

An object of the present invention is to provide a zinc-containing layer which, even without nickel, has the highest possible corrosion protection without losing its properties as a sacrificial anode. Furthermore, it is the object of the present invention to be heat-resistant in the sense of the use of the component, and to provide good protection against contact corrosion with aluminum alloys. In particular, the necessarily resulting corrosion products should be as inconspicuous as possible, especially not white and voluminous like typical zinc corrosion products.

In an embodiment, the present invention provides an aqueous, alkaline electrolyte for electrochemically depositing a zinc-, iron-, manganese-containing layer onto surfaces of metal piece goods, in particular piece goods made of iron and/or steel, characterized in that the electrolyte contains:

a. zinc ions in an amount from 4-60 g/l, preferably from 4-45 g/l, more preferably from 4-30 g/l, more preferably from 5-20 g/l, in particular from 7-10 g/l;
b. iron ions in an amount from 0.5-30 g/l, preferably from 0.5-25 g/l, more preferably from 0.6-25 g/l, more preferably from 0.7-10 g/l, in particular from 1-3 g/l;
c. manganese ions in an amount from 0.1-15 g/l, preferably from 0.1-10 g/l, more preferably from 0.2-8 g/l, more preferably from 0.2-5 g/l, in particular from 0.3 to 1 g/l.

Furthermore, the following are preferably contained:

1. Sufficient sodium hydroxide or potassium hydroxide to produce soluble zincate ions,
2. anions such as acetate, carbonate, chloride, silicate, sulfate, as counterions to the aforementioned cations and—together with the sodium ions and potassium ions—as conducting salts, and/or
3. organic additives for stabilizing soluble complexes, for uniform deposition, for improved metal distribution, and to adjust the desired gloss level.

Surprisingly, it has been found that a zinc layer with a higher iron content and at the same time a certain manganese content not only avoids the aforementioned disadvantages, but is moreover able to exceed the already outstanding corrosion protection values of zinc/nickel. This layer can be passivated in trivalent or chromium-free conversion layers, and can moreover also be provided with organic or inorganic topcoats.

The electrolyte according to the invention thereby has the following economic and ecological advantages:

The electrolyte according to the invention manages without nickel, which as a strong allergen would happily be avoided for safety reasons. However, the corrosion protection which can be produced with this electrolyte can be measured with the zinc/nickel layers according to the prior art, and thus represents a substantially better compatible alternative. Zinc, iron, and manganese are essential for humans and are generally well tolerated. The electrolyte according to the invention is alkaline, preferably highly alkaline, having a pH value of more than 13, preferably 13.5-14.5, especially approximately 14. In addition, however, it is not the source of any special hazards. Despite the increase in alloy partners from one to two, and the complexity incurred by this, the electrolyte according to the invention can be operated with the same economic efficiency as an alkaline zinc/nickel bath.

Suitable sources of zinc ions can be soluble zinc compounds such as zinc chloride, zinc sulfate, or else organic zinc compounds such as zinc methanesulfonate, for example. Zinc oxide, or also metallic zinc, is usually dissolved in the highly alkaline electrolyte, and the necessary zincate ions are thus produced.

Suitable sources of iron ions can be soluble iron compounds such as iron chloride, iron sulfate, iron carbonate, or else organic iron compounds such as iron acetate, for example.

Suitable sources of manganese ions can be soluble manganese compounds such as manganese chloride, manganese sulfate, manganese carbonate, or also potassium permanganate. The latter would preferably be reduced with a little methanol to a soluble manganese compound in a solution preparation.

The electrolyte may also contain complexing agents, in particular amines, polyalkyleneimines, dicarboxylic acids, tricarboxylic acids, hydroxycarboxylic acids, further chelating ligands such as acetylacetone, urea, urea derivatives, and further complex ligands in which the complexing functional group contains nitrogen, phosphorus, or sulfur. Further optional components of the electrolyte are additives selected from the group consisting of gloss agents, wetting agents, and mixtures thereof. These preferably include benzylpyridinium carboxylate, nicotinic acid, N-methylpyridinium carboxylate, and aldehydes.

The anode is preferably comprised of steel, nickel, nickel-plated steel, platinum-plated titanium or another platinum-plated inert metal, or titanium coated with mixed oxides or another inert metal coated with mixed oxides.

The metallic workpieces, connected as a cathode, are attached to the gantry or coated in a drum or another plant suitable for bulk workpieces.

According to the invention, a method is also provided for electrochemically depositing zinc-containing layers onto surfaces of piece goods, in which method the piece goods are introduced into an electrolyte as has been described above, and zinc-containing layers are electrodeposited onto the piece goods.

The deposition preferably takes place at a temperature of 20 to 40° C., particularly preferably at a temperature of 25° C. The current density during the deposition is preferably in a range from 0.1 to 20 A/dm<2>, in particular from 0.5 to 3 A/dm<2>.

A further subject matter of the present invention is a zinc-containing layer produced by a method as described above.

In one embodiment of the invention, the layer containing zinc, iron, and manganese contains metallic zinc and iron as well as metallic and/or oxidic manganese. The weight fractions of the elements can be measured by means of energy-dispersive X-ray spectroscopy, EDX.

In practical tests, it has been found that the weight fraction of the elements in a zinc-, iron-, manganese-containing layer deposited with the method according to the invention, measured via energy-dispersive X-ray spectroscopy (EDX) at an excitation voltage of 20 kV, is usually within the following ranges: zinc is usually in the range from 40% by weight to 96% by weight, preferably from 65% by weight to 92% by weight, even more preferably from 77% by weight to 89% by weight, respectively relative to the total weight of zinc, iron, manganese.

The weight fraction of iron is usually in the range from 4% by weight to 50% by weight, preferably from 8% by weight to 30% by weight, more preferably from 10% by weight to 20% by weight, respectively relative to the total weight of zinc, iron, manganese.

The weight fraction of manganese is usually in the range from 0.05% by weight to 10% by weight, preferably from 0.1% by weight to 5% by weight, more preferably from 0.5% by weight to 3% by weight, respectively relative to the total weight of zinc, iron, manganese.

For example, the thickness of the zinc-containing layer may vary depending on the desired corrosion protection properties. For most application purposes, it has proven to be advantageous to set the zinc-containing layer with an average layer thickness from 3 to 30 μm, preferably from 5 to 20 μm, and especially from 7 to 15 μm. The layer thickness can hereby be determined magneto-inductively, by means of X-ray fluorescence on copper parts, or by measuring a fracture in a scanning electron microscope.

According to a preferred embodiment of the invention, the zinc-, iron-, manganese-containing layer with adapted passivation, for example SurTec 680 Chromiting, imparts to an object a corrosion protection in the salt spray test according to ISO 9227 and/or ASTM B 117-73 without or with heat load, for example of 120° C. for 24 hours, until initial attack according to DIN 50961 Chapter 10, of more than 400 hours, preferably of more than 500 hours, and especially of more than 600 hours.

Objects or articles having a layer containing zinc, iron, manganese according to the invention can consequently be protected against corrosion permanently, and thus particularly advantageously. Objects or articles which have a zinc-containing layer according to the invention are also the subject matter of the present invention.

The subject matter of the present invention is also the use of a zinc-, iron-, manganese-containing layer, made from an aqueous, alkaline electrolyte according to claim 1, as corrosion protection on a metallic piece good, in particular a such a piece good made of iron and steel.

Examples

The invention is explained in more detail below with reference to several non-limiting examples.

Two electrolytes according to the invention were prepared as follows:

I. Two zinc solutions were prepared as follows:

1. 35 kg NaOH were dissolved in approximately 50 kg of softened water. 4 kg of zinc oxide were then dissolved in the hot solution while stirring. Once it had completely dissolved, it was filled with softened water to 100 kg.=SODIUM ZINCATE SOLUTION To 500 ml/l of softened water and 225 ml/l of the sodium zincate solution was added 1.5 g/l iron (as a sulfate) with 0.66 g/l EDTA and 15 g/l triethanolamine as a complexing agent. 2 g/l potassium permanganate was then dissolved therein and reduced with 4 ml/l methanol. The resulting solution was filled with softened water just up to 1 liter of electrolyte.

2. 40 kg KOH were dissolved in approximately 50 kg of softened water. 3 kg of zinc oxide were then dissolved in the hot solution while stirring. Once it had completely dissolved, it was filled with softened water to 100 kg.=POTASSIUM ZINCATE SOLUTION.

To 500 ml/l of softened water and 225 ml/l of the potassium zincate solution was added 1.5 g/l iron (as a sulfate) with 0.66 g/l EDTA and 15 g/l triethanolamine as a complexing agent. 2 g/l potassium permanganate were then dissolved therein and reduced with 4 ml/l methanol. The resulting solution was filled with softened water just up to 1 liter of electrolyte.

Both electrolytes were adjusted to be semi-bright with commercially available base and gloss additives for alkaline galvanization, for example SurTec 704 I and II. Degreased and pickled steel plates were immersed in the respective electrolytes and coated at 23° C. with a current density of 2 $A/dm^2$.

The resulting approximately 6 μm thick layer was examined in EDX. The following values were measured:

Potassium zincate electrolyte: iron: 11.8-12.5%, manganese: 0.2-2.0%, remainder zinc Sodium zincate electrolyte: iron: 11.9-12.5%, manganese: 0.2-2.0%, remainder zinc Both plates were passivated in SurTec 680 Chromiting and dried. The dried plates were annealed at 120° C. for 24 hours in order to weaken the corrosion protection according to the VDA requirements.

In the neutral salt spray test, both plates achieved anti-corrosion protection of >600 hours without discoloring or showing black dots. (Comparison: Unalloyed zinc from alkaline electrolytes would already have stronger corrosion under the same conditions, and zinc/nickel from alkaline electrolytes would have a more or less pronounced grey discoloration.)

II. A further zinc solution according to the invention was prepared as follows:

1. To 500 ml/l softened water and 225 ml/l of the sodium zinc solution from Example 1.1 was added 1.5 g/l iron (as a chloride) and 12 g/l gluconic acid as a complexing agent. 2 g/l potassium permanganate was then dissolved therein and reduced with 4 ml/l methanol. The resulting solution was filled with softened water just up to 1 liter of electrolyte.

III. Two zinc solutions NOT according to the invention were prepared as follows for comparison:

1. To 500 ml/l softened water and 225 ml/l of the sodium zinc solution from Example 1.1 was added 1.5 g/l iron (as a chloride) and 12 g/l gluconic acid as a complexing agent. The resulting solution was filled with softened water just up to 1 liter of electrolyte.
2. To 500 ml/l softened water and 225 ml/l of potassium zincate solution from Example 1.2 was added 1.5 g/l of iron (as a sulfate) and 12 g/l of gluconic acid as a complexing agent. The resulting solution was filled with softened water just up to 1 liter of electrolyte.

For comparison, in Examples III.1 and III.2 the manganese addition was omitted.

All three electrolytes were adjusted to be semi-bright with commercially available base and gloss additives for alkaline galvanization, for example SurTec 704 I and II. Degreased and pickled steel plates were immersed in the respective electrolytes and coated at 23° C. with a current density of 2 $A/dm^2$.

The resulting approximately 6 μm thick layers were examined in EDX. The following values were measured:

II.1: iron: 11.8-12.5%, manganese 0.2-2.0%, remainder zinc

III.1: iron: 11.9-12.5, remainder zinc

III.2: iron: 11.9-12.5%, remainder zinc

Plates from all three electrolytes were passivated in SurTec 675/551, a cobalt-free, silicate-containing middle layer passivation, and dried.

Whereas the samples from Example II showed neither coating corrosion ("white corrosion") nor red rust (FIG. 1) in the neutral salt spray test up to 1608 h, the samples from Examples 111.1 and 111.2 turned out distinctly worse.

Figure 2:
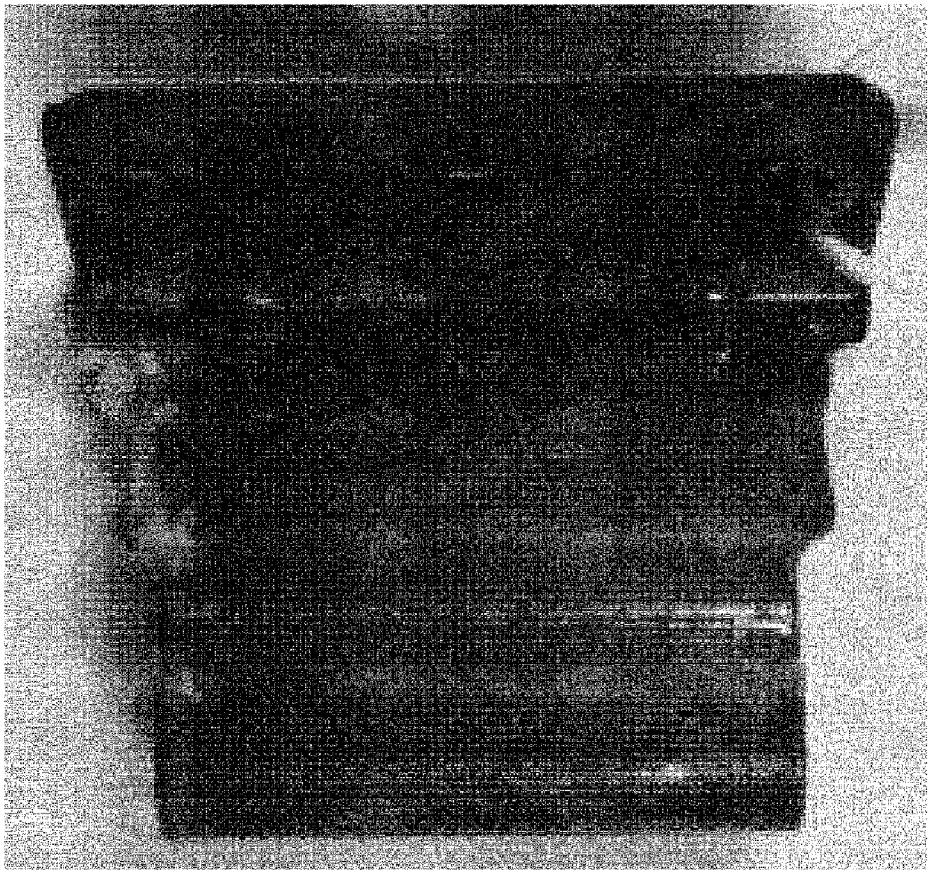
FIG. 2 depicts coating corrosion and incipient red rust at 1032 h NSS as described in the Examples.

Sample III.1 (FIG. 2) showed voluminous coating corrosion and incipient red rust at 1032 h NSS. The corrosion test was terminated here.

Figure 3:
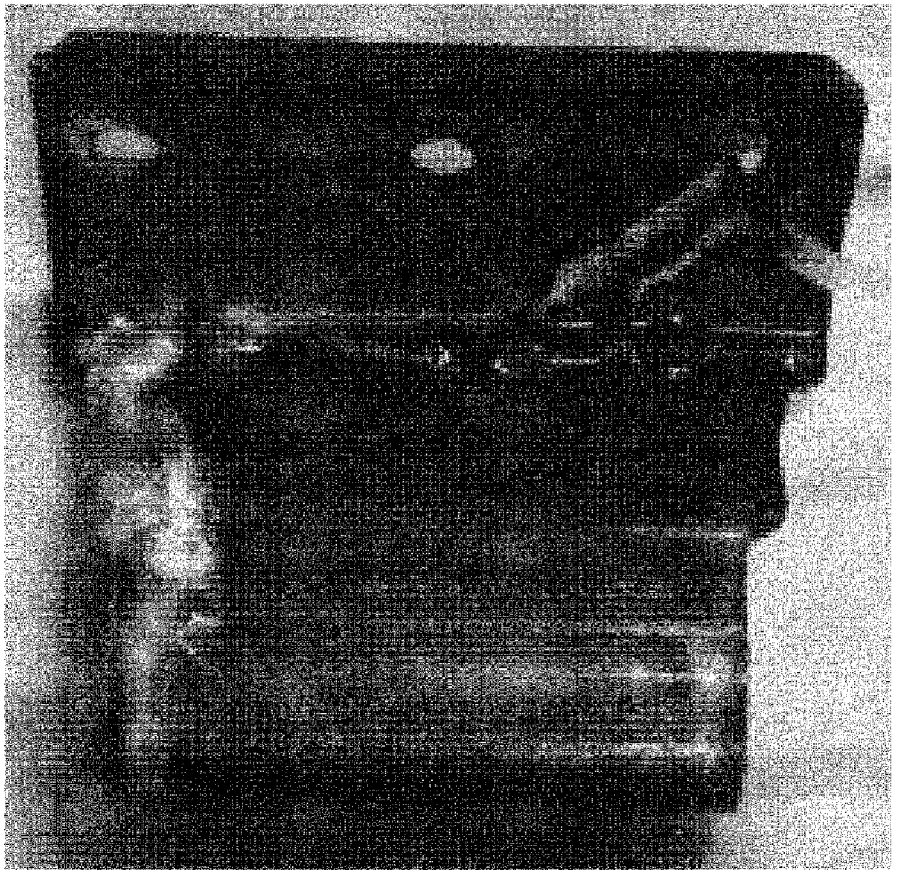
FIG. 3 depicts coating and base metal corrosion at 384 h NSS as described in the Examples.

Sample III.2 (FIG. 3) already showed coating and base metal corrosion at 384 h NSS, the experiment was terminated at 768 h neutral salt spray test (NSS) with more base metal corrosion and voluminous coating corrosion.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. An aqueous, alkaline electrolyte for electrochemically depositing a zinc-, iron-, manganese-containing layer onto surfaces of metal piece goods, wherein the electrolyte contains:

zinc ions in an amount of 4-60 g/L;
iron ions in an amount of 0.5-30 g/L; and
manganese ions in an amount of 0.2-5 g/L.

2. The aqueous, alkaline electrolyte according to claim 1, comprising manganese ions in an amount of 0.3-1 g/L.

3. The aqueous, alkaline electrolyte according to claim 2, comprising zinc ions in an amount of 4-45 g/L.

4. The aqueous, alkaline electrolyte according to claim 2, comprising iron ions in an amount of 0.5-25 g/L.

5. The aqueous, alkaline electrolyte according to claim 1, comprising:
zinc ions in an amount of 7-10 g/L;
iron ions in an amount of 1-3 g/L; and
manganese ions in an amount of 0.3-1 g/L.

6. The aqueous, alkaline electrolyte according to claim 1, wherein the zinc ions comprise zincate ions, and the electrolyte further comprises conducting salts and at least one complexing agent.

7. The aqueous, alkaline electrolyte according to claim 1, wherein the aqueous, alkaline electrolyte does not contain nickel.

8. The aqueous, alkaline electrolyte according to claim 1, wherein the metal piece goods comprise iron and/or steel.

9. A method for electrochemically depositing a zinc-, iron-, manganese-containing layer onto surfaces of metal piece goods, the method comprising introducing the metal piece goods into the aqueous, alkaline electrolyte according to claim 1 and electrochemically depositing the zinc-, iron-, manganese-containing layer onto the metal piece goods.

10. The method according to claim 9, wherein the zinc-, iron-, manganese-containing layer comprises:
zinc in an amount of 40 wt. % to 96 wt. %;
iron in an amount of 4 wt. % to 50 wt. %; and
manganese in an amount of 0.05 wt. % to 10 wt. %,
based on total weight of zinc, iron, and manganese, as measured by energy-dispersive X-ray spectroscopy at an excitation voltage of 20 kV.

11. The method according to claim 10, wherein:
the zinc is present in an amount of 65 wt. % to 92 wt. %;
the iron is present in an amount of 8 wt. % to 30 wt. %; and
the manganese is present in an amount of 0.1 wt. % to 5 wt. %.

12. The method according to claim 10, wherein:
the zinc is present in an amount of 77 wt. % to 89 wt. %;
the iron is present in an amount of 10 wt. % to 20 wt. %; and
the manganese is present in an amount of 0.5 wt. % to 3 wt. %.

13. The method according to claim 10, wherein:
the iron is present in an amount of 4 wt. % to 30 wt. %;
the manganese is present in an amount of 0.1 wt. % to 5 wt. %; and
remainder zinc.

14. The method according to claim 9, wherein the electrochemically deposited zinc-, iron-, manganese-containing layer has a thickness of 3 μm to 30 μm.

15. The method according to claim 9, wherein the electrochemically deposited zinc-, iron-, manganese-containing layer further comprises adapted passivation, and when the zinc-, iron-, manganese-containing layer comprising adapted passivation is subjected to a salt spray test according to ISO 9227 and/or ASTM B117-73, corrosion protection until initial attack of more than 400 hours is observed, wherein the corrosion protection is measured according to DIN 50961 Chapter 10.

16. The method according to claim 9, wherein the metal piece goods comprise iron and/or steel.

17. A method of protecting a metal piece good against corrosion comprising electrochemically depositing a zinc-, iron-, manganese-containing layer onto surfaces of the metal piece good, wherein the zinc-, iron-, manganese-containing layer is electrochemically deposited from the aqueous, alkaline electrolyte according to claim 1.

18. The method according to claim 17, wherein the metal piece good comprises iron and/or steel.

* * * * *